US008540447B2

(12) United States Patent
Bauer et al.

(10) Patent No.: US 8,540,447 B2
(45) Date of Patent: Sep. 24, 2013

(54) DEVICE FOR APPLYING A FLUID, GEL-LIKE, PASTY OR POWDER PRODUCT

(75) Inventors: Reinhard Bauer, Rosstal (DE); Rainer Gaebler, Uttenreuth (DE)

(73) Assignee: Schwan-STABILO Cosmetics GmbH & Co, KG, Heroldsberg (DE)

( * ) Notice: Subject to any disclaimer, the term of this patent is extended or adjusted under 35 U.S.C. 154(b) by 555 days.

(21) Appl. No.: 12/608,353

(22) Filed: Oct. 29, 2009

(65) Prior Publication Data

US 2010/0111589 A1 May 6, 2010

(30) Foreign Application Priority Data

Oct. 30, 2008 (DE) ..... 20 2008 014 451 U

(51) Int. Cl.
*A46B 11/00* (2006.01)

(52) U.S. Cl.
USPC ..... 401/122; 401/118; 401/121; 401/126

(58) Field of Classification Search
USPC ..... 401/121, 122, 126, 128, 129, 130
See application file for complete search history.

(56) References Cited

U.S. PATENT DOCUMENTS

| | | | | |
|---|---|---|---|---|
| 4,784,505 | A * | 11/1988 | Dahm | 401/122 |
| 4,886,387 | A * | 12/1989 | Goldberg et al. | 401/122 |
| 5,397,193 | A * | 3/1995 | Kirk et al. | 401/122 |
| 6,309,125 | B1 * | 10/2001 | Peters | 401/127 |
| 6,375,374 | B2 * | 4/2002 | Gueret | 401/122 |
| 6,814,084 | B2 * | 11/2004 | Gueret | 132/218 |
| 7,077,592 | B2 * | 7/2006 | Gueret | 401/128 |
| 7,201,454 | B2 * | 4/2007 | Mathiez | 300/2 |
| 2005/0175394 | A1 * | 8/2005 | Gueret | 401/126 |
| 2005/0232681 | A1 * | 10/2005 | Gueret | 401/129 |
| 2012/0294665 | A1 * | 11/2012 | Gueret | 401/122 |

FOREIGN PATENT DOCUMENTS

| | | |
|---|---|---|
| DE | 203 10 777 | 2/2004 |
| DE | 600 22 828 | 7/2006 |
| WO | WO 2006090343 A1 * | 8/2006 |

* cited by examiner

*Primary Examiner* — Gregory Huson
*Assistant Examiner* — Joshua Wiljanen
(74) *Attorney, Agent, or Firm* — Bachman & LaPointe, P.C.

(57) ABSTRACT

A device for applying a fluid, gel-like, pasty or powder product, in particular a cosmetic product, comprising
- an applicator held on a wand,
- a container for storing the product and for receiving the applicator in a rest position, and
- a wiper which in the rest position surrounds the wand in an annular shape in a contact region and bears thereagainst.

11 Claims, 2 Drawing Sheets

DEVICE FOR APPLYING A FLUID, GEL-LIKE, PASTY OR POWDER PRODUCT

BACKGROUND OF THE INVENTION

The invention concerns a device for applying a fluid, gel-like, pasty or powder product, in particular a cosmetic product, comprising an applicator means held on a wand, a container for storing the product and for receiving the applicator means in a rest position, and a wiper which in the rest position surrounds the wand in an annular shape in a contact region and bears thereagainst.

Applicator devices of the above-indicated kind are known, for example from DE 203 10 777 U1. In that case the purpose of the wiper is to clean the product off the wand, at the end of which the applicator means is disposed, to strip excess product off the applicator means and to uniformly distribute the product on the surface of the applicator means.

Particularly to ensure the cleaning action the wiper as a general rule has at least one elastic lip which snugly embraces the wand. In a case involving prolonged storage that can lead to unsatisfactory cleaning results because the lips are made predominantly from elastic materials, the elasticity of which decreases under a permanent loading.

As is more specifically already known from simple rubber rings elastic materials adapt to the shape of the enclosed article and in the course of time completely or at least partially lose their elasticity. The reason for this lies in the modular structure of the elastomers. If an elastomer is stored in a stressed condition (for example in a stretched condition) over a prolonged period of time that can involve rearrangements in the molecular structure. As a result the original elasticity of the elastomer is reduced. In addition that can also involve detachment of particles at the surface of the elastomer when subjected to a stress after prolonged storage times.

For example in the case of cosmetic applicator devices for example a dip system, it is not possible to exclude prolonged storage times. From time to time they amount to several years if the female user only rarely makes use of her cosmetics. If now the time in which the applicator device is in a closed condition is considered, then with such long storage times the time in the opened condition—that is to say the time for actually applying makeup—can be disregarded. Rather, the residence time in the closed condition can be assumed to be markedly more than 99% of the total working life.

With conventional applicator devices it is therefore repeatedly found that the wiper, after storage for a long time, is no longer capable of cleaning the wand holding the applicator means. In many cases it was even observed that the wiper breaks when removing the applicator means and the product to be applied is contaminated by broken pieces.

In addition it has been observed with conventional applicator devices that the dosage accuracy has markedly decreased, more specifically because of the loss of elasticity of the wiper. That can be seen from the fact that the wiper is no longer capable of homogeneously distributing the product to be applied on the surface of the applicator means, for which reason there is a drop at the lower end of the applicator means upon being removed from the container. That drop which is formed in particular in the case of applicator means which are not of a rotationally symmetrical configuration relative to the container axis impairs on the one hand the application result (makeup result) but it can also drop off the applicator means before reaching the application surface. Apart from the fact that the corresponding amount of product is then lost, there is the risk of soiling articles and clothing.

The object of the invention is to develop the applicator device in accordance with DE 203 10 777 U1 in such a way that the wiper functions properly even after a prolonged storage time, in particular in respect of its cleaning and distribution function.

SUMMARY OF THE INVENTION

According to the invention in a device of the kind set forth in the opening part of this specification the specified object is attained in that the outside diameter of the wand in the contact region is between 1 and 2 times as great as the internal width of the wiper without the wand fitting therein, the outside diameter of the wand viewed in the axial direction increases at least portion-wise from the contact region to the applicator means, and a first portion of the wiper has a first material and a second portion of the wiper has a second material which is harder than the first material.

Particularly the fact that the outside diameter of the wand is at a maximum twice as great as the internal width of the wiper without the wand fitting therein has the result that the wiper is not excessively stressed even in the rest position against its elastic return force, and that prolongs its working life.

As the wiper presses against the wand with its elastic return force a resistance has to be overcome when removing the wand from the rest position. In the case of conventional devices that often takes place with a jerk so that the risk of shaking off and spilling the product is very high.

In accordance with the invention therefore there is an increase in diameter of the wand viewed in the axial direction from the contact region to the applicator means. Accordingly upon removal of the applicator means, a resistance is to be felt, which prepares for complete removal of the wand with the applicator means from the container. In that way it is possible to avoid jerked removal and shaking and spilling of the product to be applied.

In a particularly preferred embodiment of the invention it is provided that the outside diameter of the wand in the contact region is between 1.2 and 1.5 times as great at the internal width of the wiper without the wand fitted therein. In other words in accordance with this configuration of the invention the prestressing of the wiper is very slight in the rest position. The wiper is almost completely relieved of the load of elastic return forces, which increases its working life.

According to the invention the contact region is preferably cylindrical.

It is further preferably provided in accordance with the invention that the diameter of the wand viewed in the axial direction firstly increases at least portion-wise from the contact region to the applicator means and then decreases at least portion-wise. That portion in which the diameter decreases at least portion-wise can serve as a centering aid when inserting the wand holding the applicator means into the wiper and thus into the container.

In accordance with a particularly preferred embodiment of the invention it is provided that the portion of the increase in diameter and/or the reduction in diameter is/are of a conical configuration. In particular, because of the steady enlargement in diameter which is achieved in that way, adjoining the contact region, removal of the applicator means from the container involves feeling a resistance which steadily increases in the same manner so that even better preparation occurs for the moment at which the applicator means leaves the container. That further contributes to avoiding product being shaken off and spilt or the like.

A similar consideration applies for the conical reduction. More specifically the conical reduction is particularly favorable in terms of the function of the centering aid upon insertion of the wand holding the applicator means, into the wiper and the container.

In accordance with the invention in a further preferred feature there is provided a cylindrical intermediate region between the portion which increases in diameter and the portion which decreases in diameter.

In that respect it is further preferred in accordance with the invention that the outside diameter of the intermediate region is between 1.5 and 2.5 times as great as the outside diameter of the contact region.

In accordance with a further preferred embodiment of the invention the wand is flexible. As the wand increases in diameter in the portion between the contact region and the applicator means, it is primarily bent under a corresponding stressing in that region which, as viewed from the applicator means, is behind the contact region. In other words, under a corresponding stressing, the entire wand flexes, which is particularly advantageous for the application result. That applies in particular in regard to use of the device for applying cosmetics in the eye region or in the region of local inflammation (for example acne), that is to say in a highly sensitive region. In addition the flexibility of the wand also improves handling when pulling the wand which holds the applicator means out of the container. In the application procedure the applicator means can deflect as a whole, which leads to a particularly attractive and soft application feel.

According to the invention preferably the wiper includes thermoplastic material, in particular at least one thermoplastic elastomer.

It is particularly advantageous if the wiper includes at least one substance from the group:

styrene block polymers,
polyester elastomers,
polyurethane elastomers,
soft polyolefin thermoplastic materials, and
thermoplastic polyamide.

Further in accordance with the invention the wiper can have a TPE blend with a thermoplastic matrix and elastic particles. The elastic particles impart an elastic suitability for use to the plastic material. What is important in that respect is good intermixing and adhesion of the matrix to the particles.

Preferably the wiper has PP-EPDM, PP-NR, PP-IIR blends and/or polyolefin thermoplastic materials such as a PP-EPM blend.

The portion of the wiper, which is made from the harder material, serves according to the invention for anchoring the wiper to the container while the softer portion ensures the actual wiper functions.

Preferably according to the invention the two portions of the wiper are joined together in an indenting relationship.

They can however also be integral with each other.

In a particularly preferred embodiment of the invention at least one of the two portions of the wiper is integral with the container.

For manufacturing purposes it is possible to make use of two-component or multi-component injection molding.

According to the invention the applicator means can be of any desired configuration. That includes in particular a configuration which is not rotationally symmetrical with respect to the container axis. An example is the 'deer foot'.

BRIEF DESCRIPTION OF THE DRAWINGS

The invention is described more fully hereinafter by means of a preferred embodiment by way of example with reference to the accompanying drawing, with further details. In the drawing.

DETAILED DESCRIPTION

Figure 1:
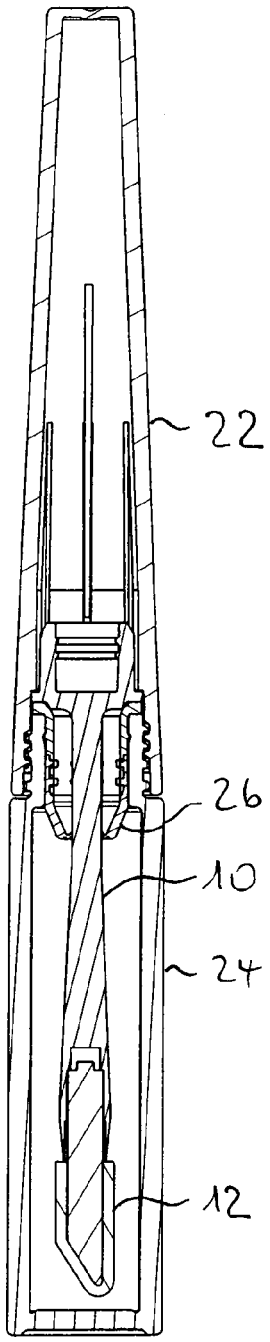
FIG. 1 shows a longitudinal section of an applicator device in accordance with an embodiment of the invention.
Figure 2:
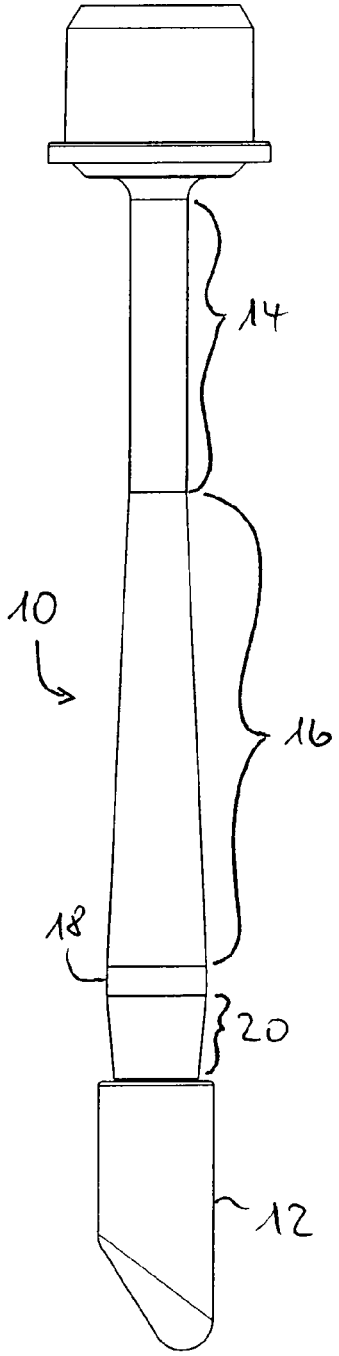
FIG. 2 shows a view of the wand of the applicator device of FIG. 1 with applicator means.
Figure 3:
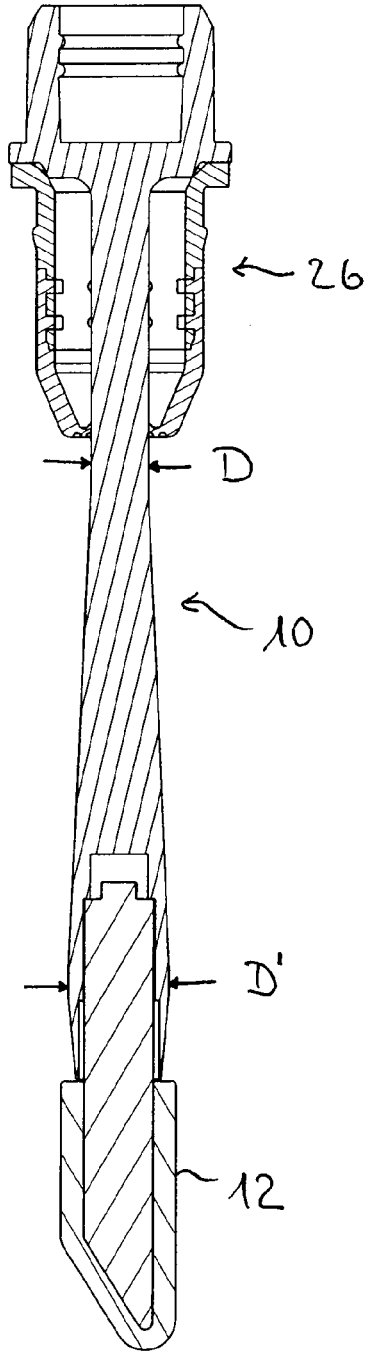
FIG. 3 shows the same view as FIG. 2 but in longitudinal section and with a wiper.
Figure 5:
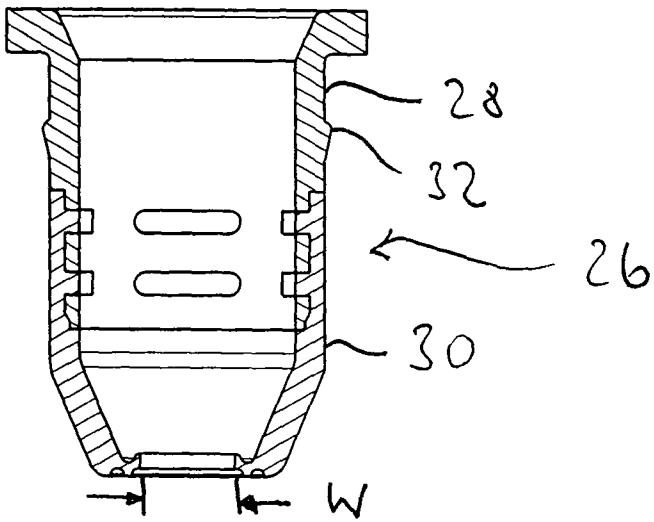
FIG. 5 shows a longitudinal section of the wiper of FIG. 4.
Figure 4:
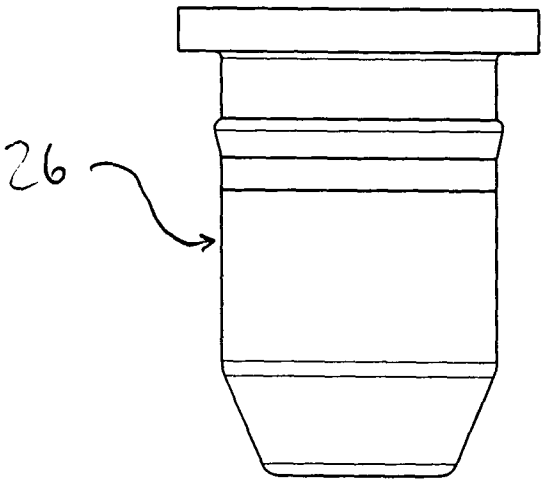
FIG. 4 shows a side view of the wiper of the applicator device of FIG. 1.

The applicator device shown in the drawing includes a wand 10 holding an applicator means 12 in the form of a 'deer foot'. The wand 10 is of a round cross-section. It has a cylindrical contact region 14 having a length $L_1$, a conically increasing region 16 having a length $L_2$, a cylindrical intermediate region 18 having a length $L_3$ and a conically decreasing region 20 having a length $L_4$. It is held by a holder 22 which in turn can be screwed on to a container 24. Disposed in the container 24 is a cosmetic product (not shown in the drawing), for example red lipstick.

A wiper 26 is mounted to the upper edge of the container 24. The wiper 26 has two components, namely a hard component 28 and a soft component 30 which are joined together in indenting relationship. They are produced in a single working operation by way of two-component injection molding. An annular rib 32 serves for holding it in the container 24.

In the illustrated embodiment the hard component 28 is of hard TPU while the soft component is of soft TPU.

Polypropylene can also be considered as the material for the soft component 30.

The soft component 30 is elastically yielding in consideration of the functions attributed thereto.

In the illustrated embodiment the outside diameter D of the contact region 14 of the wand is 2.5 mm. The internal width W of the inside contour of the wiper 26 in the illustrated embodiment is 2 mm in the rest condition, that is to say without the wand fitting therein. In the illustrated embodiment therefore the outside diameter D is 1.25 times as great as the internal width W of the wiper 26 without the wand fitting therein. In the illustrated embodiment the outside diameter D' of the intermediate region 18 is 1.74 times as great as the outside diameter D of the contact region 14.

The features disclosed in the foregoing description, in the claims and in the drawing can be essential both individually and also in any combinations for carrying out the invention in its various embodiments.

The invention claimed is:

1. A device for applying a fluid, gel-like, pasty or powder product, in particular a cosmetic product, comprising:

a wand adapted to be received in a wiper, the wand comprising a first cylindrical contact region having a length $L_1$ of constant diameter D, a first conical region extending from an end of the first contact region wherein the first conical region increases in diameter as it extends from the first contact region and has a length $L_2$, wherein $L_2$ is greater than $L_1$, a second cylindrical intermediate contact region having a length $L_3$ extending from an end of the first conical region and having a constant diameter D', wherein $L_3$ is less than $L_1$ and D' is between 1.5 and 2.5 D, and a second conical region extending from the second intermediate contact region wherein the second conical region decreases in diameter as it extends from the second cylindrical intermediate region, is at least hollow in part for receiving a portion of the applicator and has a length $L_4$ wherein $L_3<L_4<L_1<L_2$;

the wiper which in the rest position has a contact portion which surrounds the first contact region of the wand and bears against the first contact region, wherein the diameter D of the first contact region of the wand is greater than and up to 2 times as great as an internal width W of the contact portion of the wiper when the wand is not fitted in the wiper; and the contact portion of the wiper is formed of a first material and a second portion of the wiper is formed of a second material which is harder than the first material.

2. A device as set forth in claim 1 wherein the outside diameter D of the wand in the first contact region is between 1.2 and 1.5 times as great at the internal width W of the wiper without the wand fitted therein.

3. A device as set forth in claim 1 wherein the wand is flexible.

4. A device as set forth in claim 1 wherein the wiper includes thermoplastic material.

5. A device as set forth in claim 1 wherein the wiper includes at least one substance selected from the group consisting of:

styrene block polymers,
polyester elastomers,
polyurethane elastomers,
soft polyolefin thermoplastic materials, and
thermoplastic polyamide.

6. A device as set forth in claim 1 wherein the wiper has a TPE blend with a thermoplastic matrix and elastic particles.

7. A device as set forth in claim 1 wherein the wiper has PP-EPDM, PP-NR, PP-IIR blends and/or polyolefin thermoplastic materials.

8. A device as set forth in claim 1 wherein the first and second portions of the wiper are joined together in an indenting relationship.

9. A device as set forth in claim 1 wherein the first and second portions of the wiper are integral with each other.

10. A device as set forth in claim 1 wherein at least one of the first and second portions of the wiper are integral with the container.

11. A device as set forth in claim 1 wherein the applicator means is of a non-rotationally symmetrical configuration with respect to the container axis.

* * * * *